US005417390A

United States Patent [19]

Southwick

[11] Patent Number: 5,417,390

[45] Date of Patent: May 23, 1995

[54] CONTROLLED RAM-AIR INFLATED KITE WITH X-BRACED BRIDLE AND OPERATOR HARNESS WITH ANCHOR

[76] Inventor: Jeffrey M. Southwick, 304 Marble Dr., Antioch, Calif. 94509

[21] Appl. No.: 204,639

[22] Filed: Mar. 2, 1994

[51] Int. Cl.[6] ..... A63H 27/08; B64C 31/06

[52] U.S. Cl. ..... 244/155 A; 244/153 R; 244/155 R

[58] Field of Search ..... 244/142, 145, 146, 151 R, 244/151 A, 152, 153 R, 155 R, 155 A

[56] References Cited

U.S. PATENT DOCUMENTS

| | | | |
|---|---|---|---|
| 2,388,478 | 11/1945 | Garber | 244/153 |
| 3,806,071 | 4/1974 | Brown | 244/155 R |
| 4,129,272 | 12/1978 | Jones et al. | 244/153 R |
| 4,634,080 | 1/1987 | McNally | 244/142 |
| 4,738,414 | 4/1988 | McCulloh | 244/155 R |
| 4,846,423 | 7/1989 | Reuter | 244/145 |
| 4,846,424 | 7/1989 | Prouty | 244/153 R |
| 5,024,401 | 6/1991 | Nakashima | 244/155 R |
| 5,033,698 | 7/1991 | Schimmelpfenning | 244/153 R |
| 5,080,191 | 1/1992 | Sanchez | 244/151 R |
| 5,213,288 | 5/1993 | Girwood | 244/145 |
| 5,251,853 | 10/1993 | Ogawa | 244/145 |
| 5,322,247 | 6/1994 | Munday et al. | 244/155 A |

FOREIGN PATENT DOCUMENTS

| | | | |
|---|---|---|---|
| 379610 | 8/1990 | European Pat. Off. | 244/145 |
| 496836 | 11/1919 | France | 244/142 |

OTHER PUBLICATIONS

"Kite Lines", Stacking Heavy Numbers in the Windy City pp. 64–67 Summer 1986.

*Primary Examiner*—Andres Kashnikow
*Assistant Examiner*—Virna Lissi Mojica

[57] ABSTRACT

A ram-air inflated kite has double contoured surfaces separated by dividers that form a series of air-catching cells between the surfaces. The contour of the surfaces produces lift in the kite similar to the airfoil of an airplane wing. The kite may be flown as a single airfoil or have other kite airfoils stacked one above the other for flight as a multiple in an attached stacked formation. Special X-bracing in lines between the stacked airfoils provide stability and the kite sections can be controllable by a bridle on the kite connected by control lines. For additional control and stabilization, the operator is provided with a body harness having attachments that can be connected directly to the kite control lines. For operator safety, the body harness is secured by a swivel tee anchored by two ground stakes.

6 Claims, 8 Drawing Sheets

CONTROLLED RAM-AIR INFLATED KITE WITH X-BRACED BRIDLE AND OPERATOR HARNESS WITH ANCHOR

BACKGROUND OF THE INVENTION

1. Field of the Invention

This invention relates to ram-air inflated kites having contoured upper and lower surfaces formed into a longitudinal alignment of transverse cell by dividers between the surfaces. The kite structure is usually of a pliable soft material and is shaped similar to the airfoil of an airplane wing. Air passing through the divided sections inflates the cells and maintains the airfoil shape. The movement of air through, over, and under the airfoil shape provides ram-air kites with excellent lift and flight characteristics. The present invention is particularly directed towards a ram-air inflated kite with a special line X-bracing arrangement for control of stacked kites and a harness for the operator with a safety anchoring device attachable to the harness.

2. Description of the Prior Art

In the past art, airfoil structure is seen in several particular types of kites and in some controllable parachutes. A typical kite using air-foil design is seen in U.S. Pat. No. 3,806,071, issued to Brown on Apr. 23, 1974. The Brown patent shows a kite using a flexible airfoil with air receiving pockets to increase flight ability. The device is made of fabric and has no frame. Brown uses a plurality of attachments so the kite can be flown at different angles or attitudes. For additional stabilization, a drogue, a bag-like drag, is used as a tail.

An inflatable airfoil is seen in the Jones et al. U.S. Pat. No. 4,129,272. The Jones et al. patent is dated Dec. 12, 1978. This device uses a flexible spar aligned with pockets resembling an airplane wing. Control lines attach to the outer ends of the spar and the spar can bend in flight to accommodate variations in air speed over the envelope. Although not shown in the drawings or discussed in the specification, the Jones kite could be stacked by attaching bridal lines from one airfoil to the other at the spar ends.

A gliding wing parachute apparatus is shown in the Reuter patent. The patent was issued on Jul. 11, 1989 as U.S. Pat. No. 4,846,423. A plurality of ram-air inflated cells are affixed with a multiple of attachment lines. The cells can vary in size and materials used can differ dependent upon a loading factor.

A ram-air airfoil stunt kite is shown in U.S. Pat. No. 4,846,424, issued to Prouty, Jul. 11, 1989. Dual bridles are attach to two control lines. The bridles are formed by lines in triangular attachment from the control line points upward to attachment points on each half of the kite structure. As wind velocity increases, the Prouty kite becomes transversely curved. This is said to enhance the controllability of the kite for stunt maneuvers.

Kites structured in curved airfoil form and using ram-air inflation seen in past art patents and in the market place have many good features but are often cumbersome and difficult to control. Some airfoils rigged as shown do not actually provide good control of kites in stacked formation. This is especially true of the bridal arrangements. Kite stacking (affixing one complete kite above another so both independent airfoils act as one) is becoming increasingly popular. For kite stacking with adequate control, special rigging is needed. Until the present invention, that special rigging has not been available.

SUMMARY OF THE INVENTION

Therefore, in practicing my invention, I have provided new technology in ram-air inflated kites and in controls for single kites and for kites attached in stacked formation. The new technology includes a body harness secured by a swivel tee anchored by two ground stakes and X-bracing attachment lines between the kite panels. The X-bracing stabilize controlling the airfoils while using dual line controls or quad controls for stacked kites. The X-braced lines and simple bridle structure of the present invention eliminates many of the multiple bridle lines required on other stacked ram-air kites. In a dual control arrangement for kites in stacked formation, two control lines affixed by bridles to the leading edges and sides of the airfoils can be used by a ground operator to provide him/her with excellent control of the kites. In the technology of the present invention, kite maneuverability is increased and stability is acquired using quad lines for controlling attached kites in stacked formation or for flying single kites. The quad line system uses two control lines attached by bridles to the leading edge of a single kite or to leading edges of stacked kites and two brake lines connected to the trailing edge of a single kite or to the trailing edges of stacked kites. In this technology, dual line controls are used for leading edge control and quad line controls are used for controlling stacked or single kites from the trailing edge. X-bracing the leading edge lines prevents the kite structures from collapsing. The trailing edge X-bracing lines keeps an upper kite of a stacked formation from spinning relative to a lower or base kite. The kite structure of the present invention is different from other ram-air inflated kites that curve under air pressure, in that the bridle design maintains the kite aerodynamical aligned under different wind conditions. In design, the kite of the present invention is a ram-air inflated airfoil having double contoured surfaces separated by dividers that form a series of air-flow passages or cells between the surfaces. The cells are open at the front, the leading edge, and closed at the back, the trailing edge of the airflow structure. This provides a captive air compartment and maintains the air-foil shape of the kite without rigid frame work. The contour of the surfaces produces lift in the kite similar to the airfoil of an airplane wing. My kite may be flown as a single airfoil or have other kite airfoils stacked one above the other for flight as multiples in a stacked-kite formation. The special attachment line X-bracing between the stacked airfoils provides stability and the kite sections can be attached by bridle lines that pass through the kite structure at special points. The pass-through points are arranged so that each kite is divided into two equal sections regardless of length or number of sections in each side. Each half of the kite has a line passing through the center of that half. Thus the kite is considered as two halves with a line passing in the center of each half. The lines pass through bridal apertures opened through the lower kite panel, The line X-bracing and the simple bridle structure of the present invention eliminates many of the multiple of control lines required on other ram-air inflated kites in stacked formation. Maneuverability and stability is acquired using quad line for controlling stacked or single kites in the arrangement provided by the present invention. For safety and for ease in manipulating the control lines they are directly connection to a body harness worn by the operator. Additional safety is provided for the operator in the present invention by fittings on the body harness for attachment to a swiveling anchor device secured to the ground by two ground stakes. The ground stakes prevents the operator from being airborne should unexpected gusty winds lift the kite sufficiently to cause the operator to lose his footing. The swivel allows the operator to move around the anchor in accordance with wind direction changes. Thus the present invention is particularly designed for flight stabilization and better control through use of the X brace on a kit stack (multiple kites) enhanced by a harness worn by the operator, the harness having attachments for securement to a ground-staked anchor.

A principal object of the present invention is to provide a ram-air inflated kite airfoil that will maintain its longitudinal airfoil shape and its transverse airfoil shape while in flight without needing rigid structure.

Another object of my invention is providing stabilizing X-bracing in support lines preventing an upper kite from twisting relative to a lower kite in a staked-kite formation.

A further object of this invention is to provide ram-air inflated kites having control lines both dual and quad that attach by bridle and have extension passed through a lower kite airfoil to an upper kite airfoil centrally providing maintenance for the integrity of the airfoils.

A still further object of the invention is to provide an airfoil in a ram-air inflated kite made of pliable materials strong during flight use, easily deflated, and made into a small package for transporting.

Other objects and the many advantages of the present invention will become understood by reading about numbered parts in the specification and comparing them to like numbered parts illustrated in the drawings.

A study of the illustrations will acquaint anyone with the uniqueness of the present invention.

DESCRIPTION OF A PREFERRED EMBODIMENT

Figure 1:
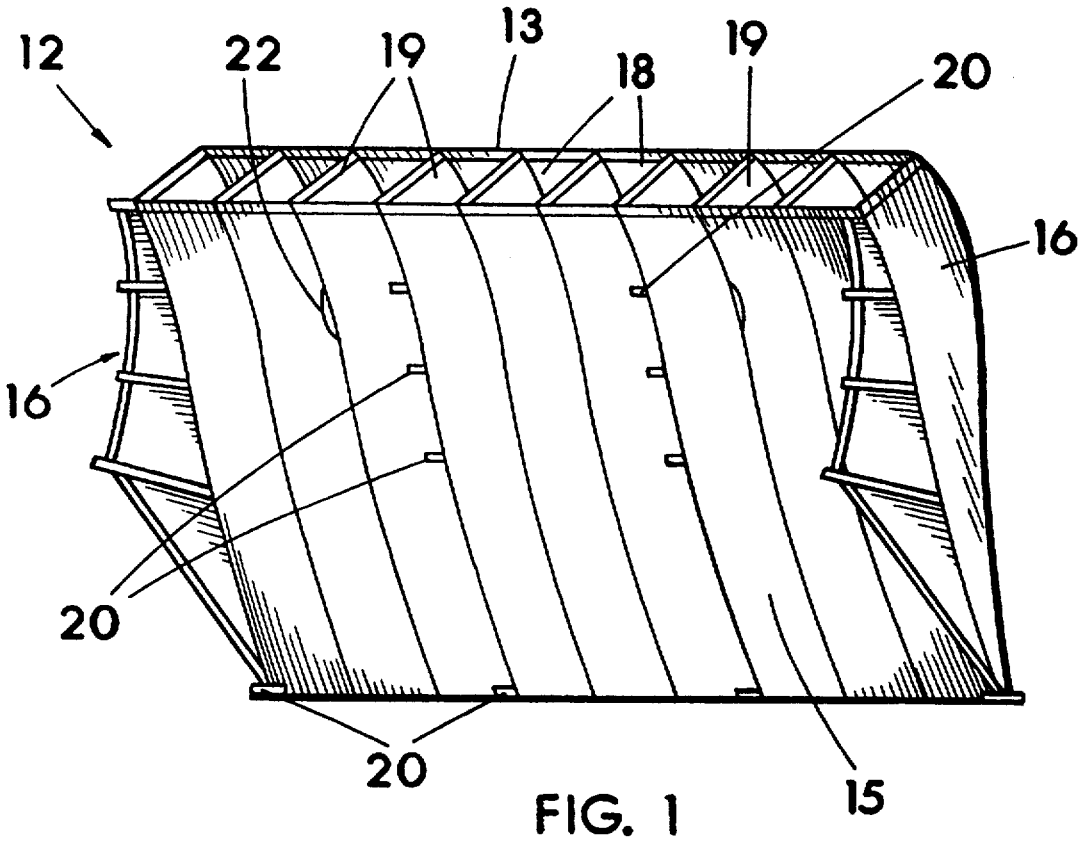
FIG. 1 showing a perspective view of a ram-air inflated kite according to the invention positioned to illustrate the undersurface of an airfoil panel fitted with control attachments and bridle pass-through apertures. The airfoil panel illustrated would ordinarily be the upper kite in a stacked-kite formation.
Figure 2:
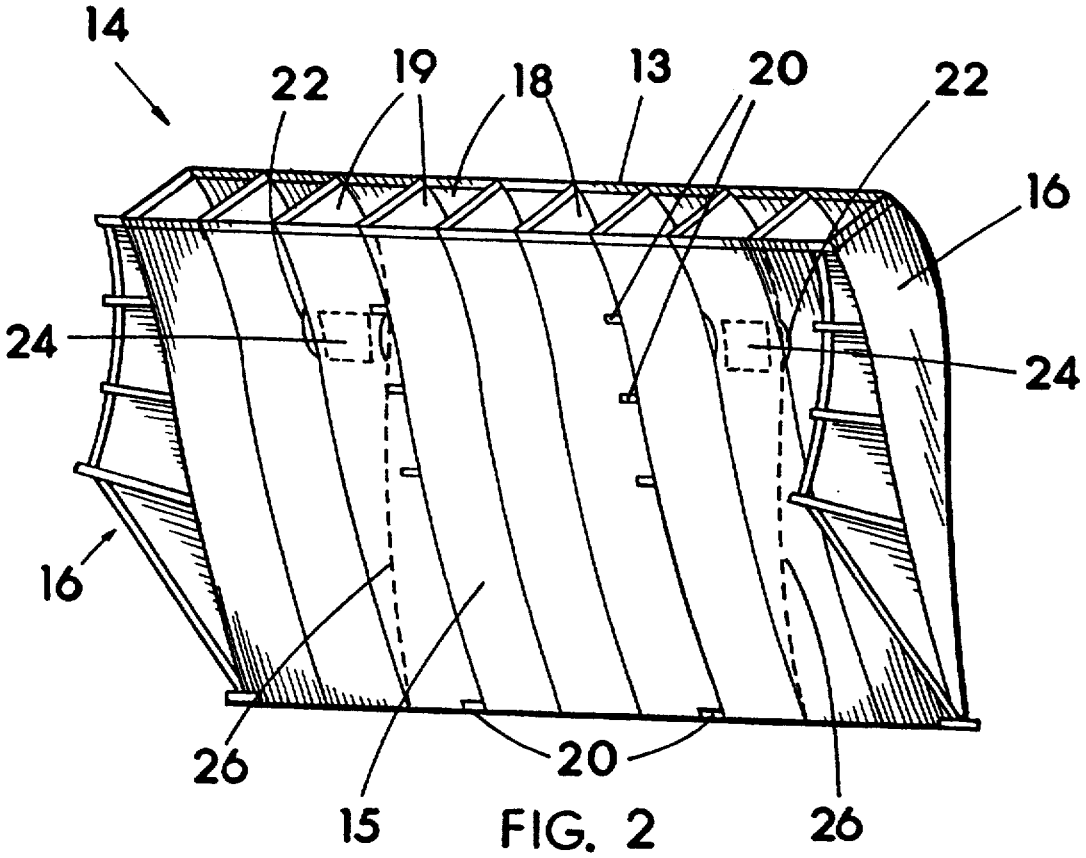
FIG. 2 showing a perspective view of the ram-air inflated kite of this invention from the airfoil underside. The bridle and line attachment fittings with line pass-through openings are indicated. The airfoil shown in FIG. 2 is arranged to be used as a single kite or the lower kite in a stacked-kite formation.

Referring now to the drawings at FIG. 1 and FIG. 2. The upper airfoil panel kite 12 is shown in FIG. 1 and the lower airfoil panel kite 14 is shown in FIG. 2 relative to the positions they would assume in a stacked-kite formation. Kite 12 in FIG. 1 and kite 14 in FIG. 2 are positioned to show undersurface 15 so line attachment tabs 20 and line openings 24 can be seen. The airfoil panel structure of kites 12 and 14 are similar both having end stabilizer end panels 16 at the ends and dividers 19 aligned along inside between upper surface 13 and lower surface 15 running from the leading edge to the trailing edge. Dividers 19 form a series of air-filling sacks called cells 18. Cells 18 are open at the leading edge of kites 12 and 14 and closed at the trailing edge. Kites 12 and 14 are of flexible structure and can be manufactured of plastic, rip-stop nylon, and rip-stop polyester fabrics. Although dividers 19 and the supports adjacent end panels 16 appear rigid, the structure is in the form of seams and not framework. Kites 12 and 14 maintain their airfoil shape when flown by ram-air inflation, air passing into and restricted in cells 18. In FIG. 1, bridal openings 22 in the bottom surface 15 of kite 12 can be seen adjacent line attachment tabs 20. In FIG. 2, control line openings 24 are indicated by dotted lines adjacently above line attachment tabs 20 on the upper surface 13 next to surface contour lines 26 also indicated by dotted lines. It should be noted that the tabs and openings are positioned in a manner to divide each kite 12 and 14 into two half sections. This positioning of the tabs and control lines provides better flight and control characteristics for kites 12 and 14 when in attached kite-stacked formation as shown in FIG. 3.

Figure 3:
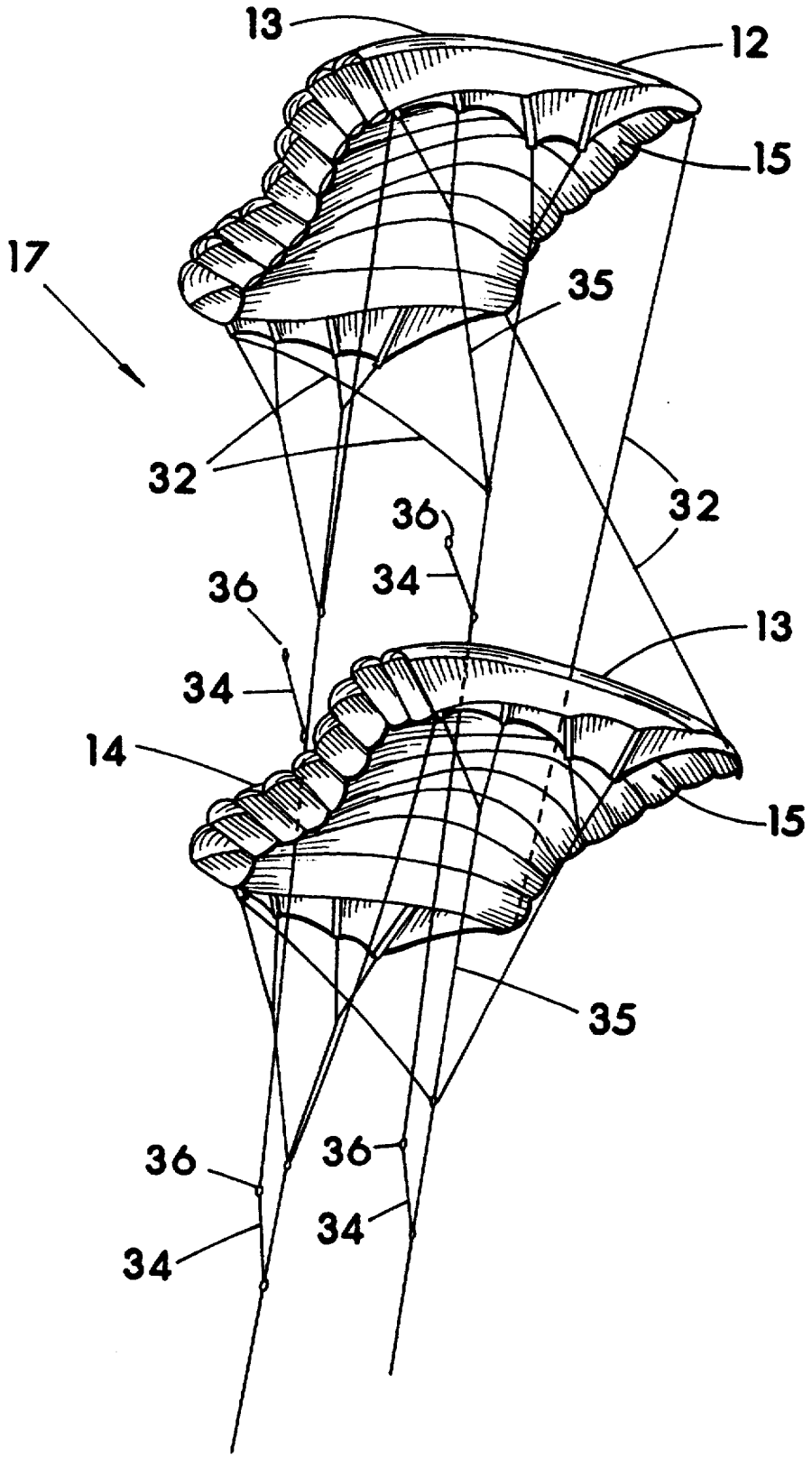
FIG. 3 showing the kites of FIG. 1 and FIG. 2 in stacked-kite formation. The two kites are rigged with bridles and control lines. Dual control lines are shown in this illustration with the lines passing through the lower airfoil panel and connected by bridle to the upper airfoil panel. Line X-bracing, restricting kite spin, is accomplished in the lines attached at the trailing edges between the two kites.

FIG. 3 illustrates dual controls 17 of kite 12 (upper) and kite 14 (lower) fully rigged in attached stacked-kite formation. The illustrations show how, when cells 18 are filled with air, upper panel 13 and lower panel 15 in kites 12 and 14 form an aircraft-like airfoil. The shape is maintained without rigid framework because of dividers 19 forming a series of air intakes, cells 18 described before under FIG. 1 and 2. The lines forming X-bracing 32, an essential part of this invention, can be seen in at leading edge and the trailing edge connection lines between kites 12 and 14. This special line X-bracing 32 prevents the kites from twisting relative to each other and provides better control for the operator. The line assemblage further includes risers 34 with loops 36 on the ends and stabilizer lines 35 that are in fact bridal extensions of the control lines (see control lines 40 in FIG. 4). Triangular bridal formations and risers 34 with connector loops 36 at the ends makes changing controls from dual (two) to quad (four) easy. For storage or transportation, the kite connectors and control system can be disconnected, the kites 12 and 14 deflated, and the entire assemblage rolled up into a small package.

Figure 4:
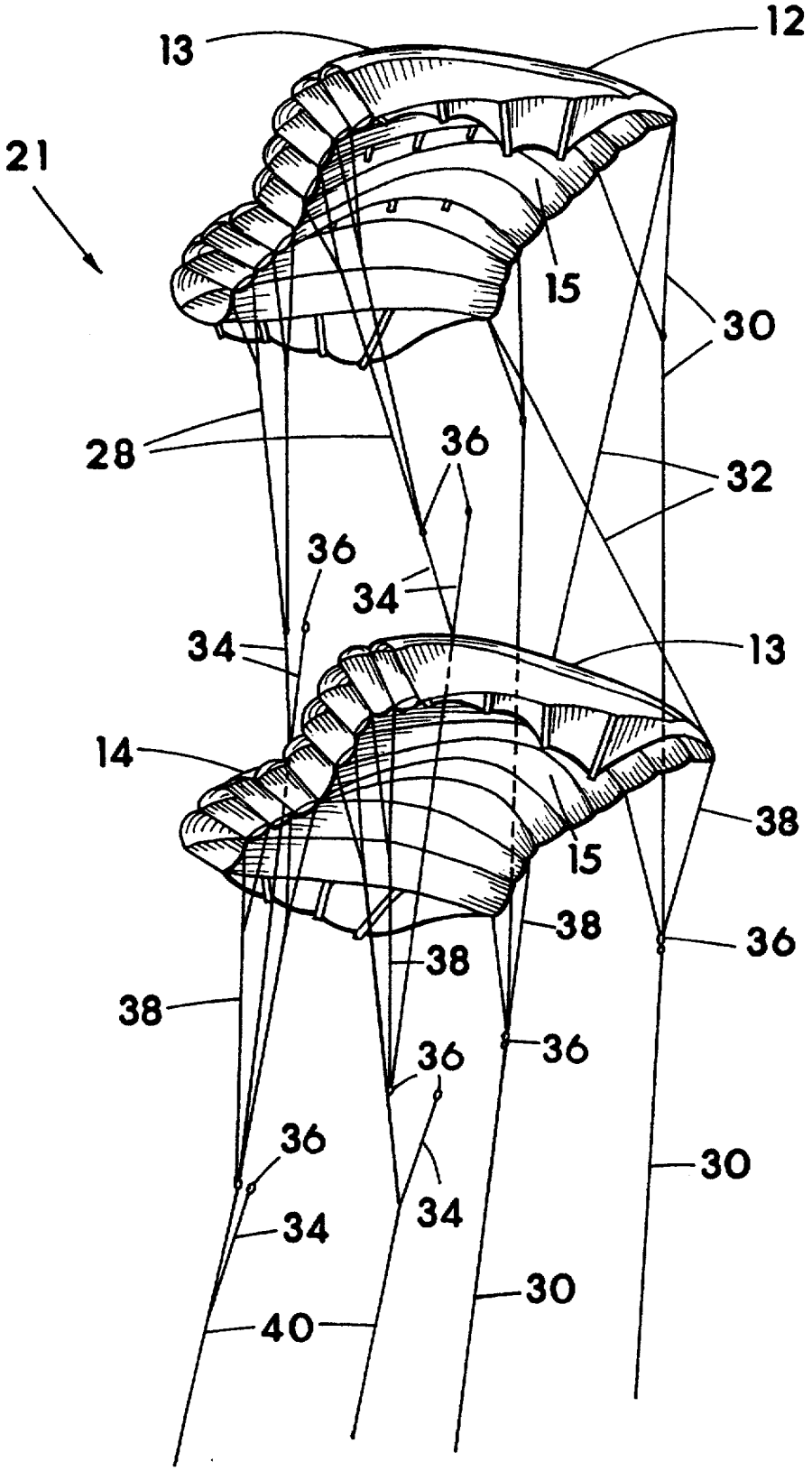
FIG. 4 showing a perspective view of the kites of this invention attached in stacked formation and fully rigged with quad control lines. X-bracing lines are affixed at the trailing edges between the two kites with brake lines on each side.

When an operator flies stacked kites with four control lines, this arrangement is called quad controls and is illustrated in FIG. 4 as quad controls 21. Quad controls 21 allows an experienced kite flyer optimum control for maneuvering and stunting his/her kites. In a quad arrangement, two control lines 40 and two brake lines 30 are provided. Control lines 40 attach to risers 34 and by loops 36 to stack bridles 38. Bridles 38 are lines in a triangular arrangement affixed to the leading edge of both kites 12 and 14 that distribute the control load along the leading edge of the kite airfoils. Lead lines 28 complete the extension of control lines 40 between kites 14 and 12. Brake lines 30 are also affixed by loops 36 to bridles 38. Bridles 38 are also an arrangement of triangular lines that attach along the trailing edge of lower kite 14. Brake lines 30 are continued upward above kite 14 to connect at the trailing edge of upper kite 12 in a triangular arrangement with X-bracing 32 in special lines between brake lines 30. For additional rigging or control changes, free end risers 34 with loops 36 on the free end can be seen in FIG. 3 and FIG. 4. It is noted that for more direct control, control line extensions, risers 34, pass through line openings (openings 20, see FIG. 2) in the surfaces 15 and 13 of lower kite 14.

Figure 5:
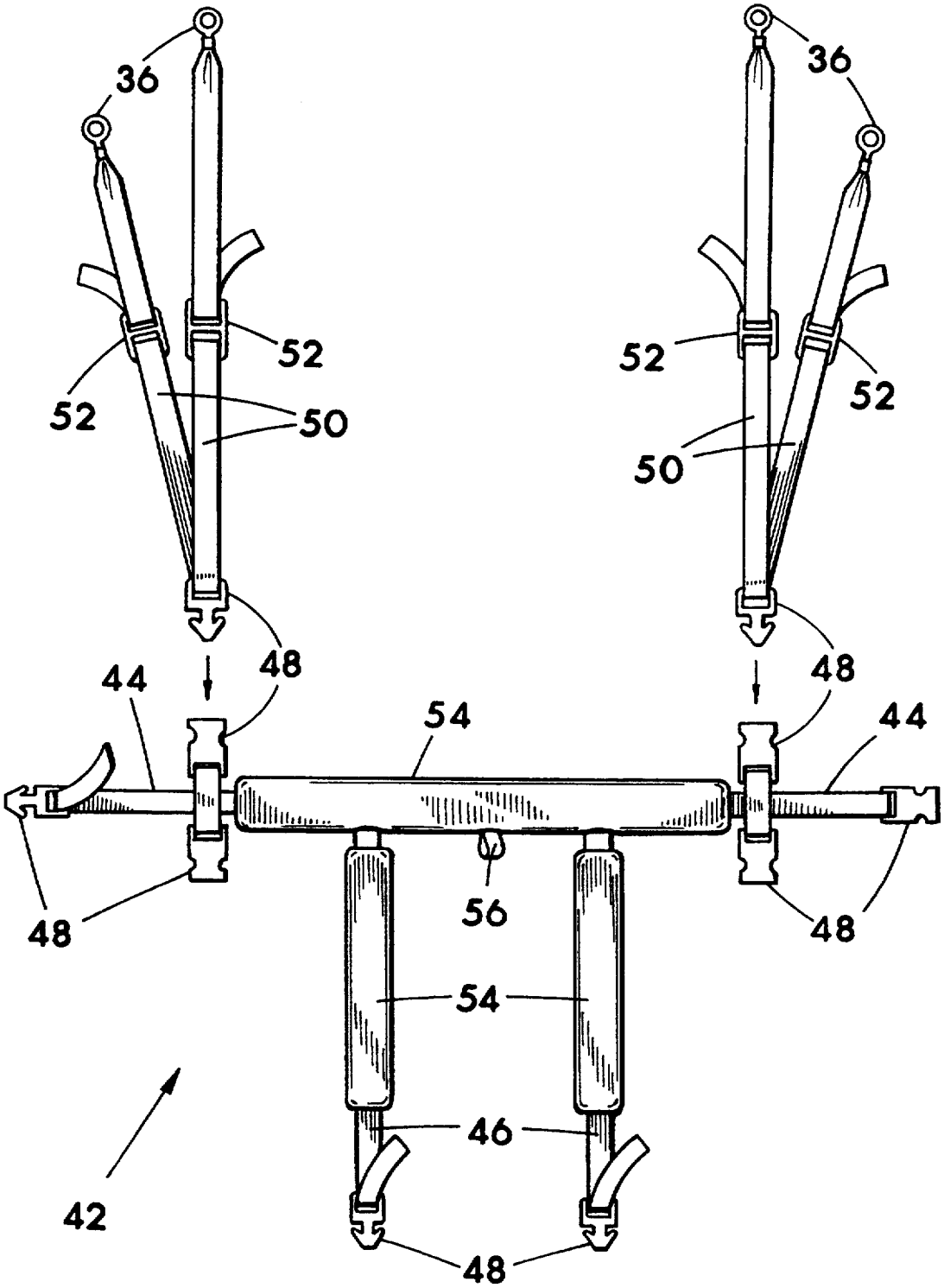
FIG. 5 showing a body harness in accordance with the invention illustrating detachable control straps and padding to protect the operator.

FIG. 5 shows the body harness 42 in accordance with this invention. Harness risers 50 that connect to the control lines 40 and 30 are shown detached from belt 44. Belt 44 is shown opened to disclose pads 54, that cover most of the back of belt 44 and the leg straps 46. Trim control adjusters 52 are seen on both harness risers 50 and adjustable snap buckles 48 are used for all belt attachments and for buckling-on belt 44. Belt loop 56 can be seen centered at the bottom edge rear of belt 44. This is for a single line attachment to a security stake. Two more loops 56 that cannot be seen are also affixed to belt 44 right behind leg strap 46 attachments. The unseen loops 56 are for attachment to the special staked swivel-T anchor 58 as shown in FIG. 6.

Figure 6:
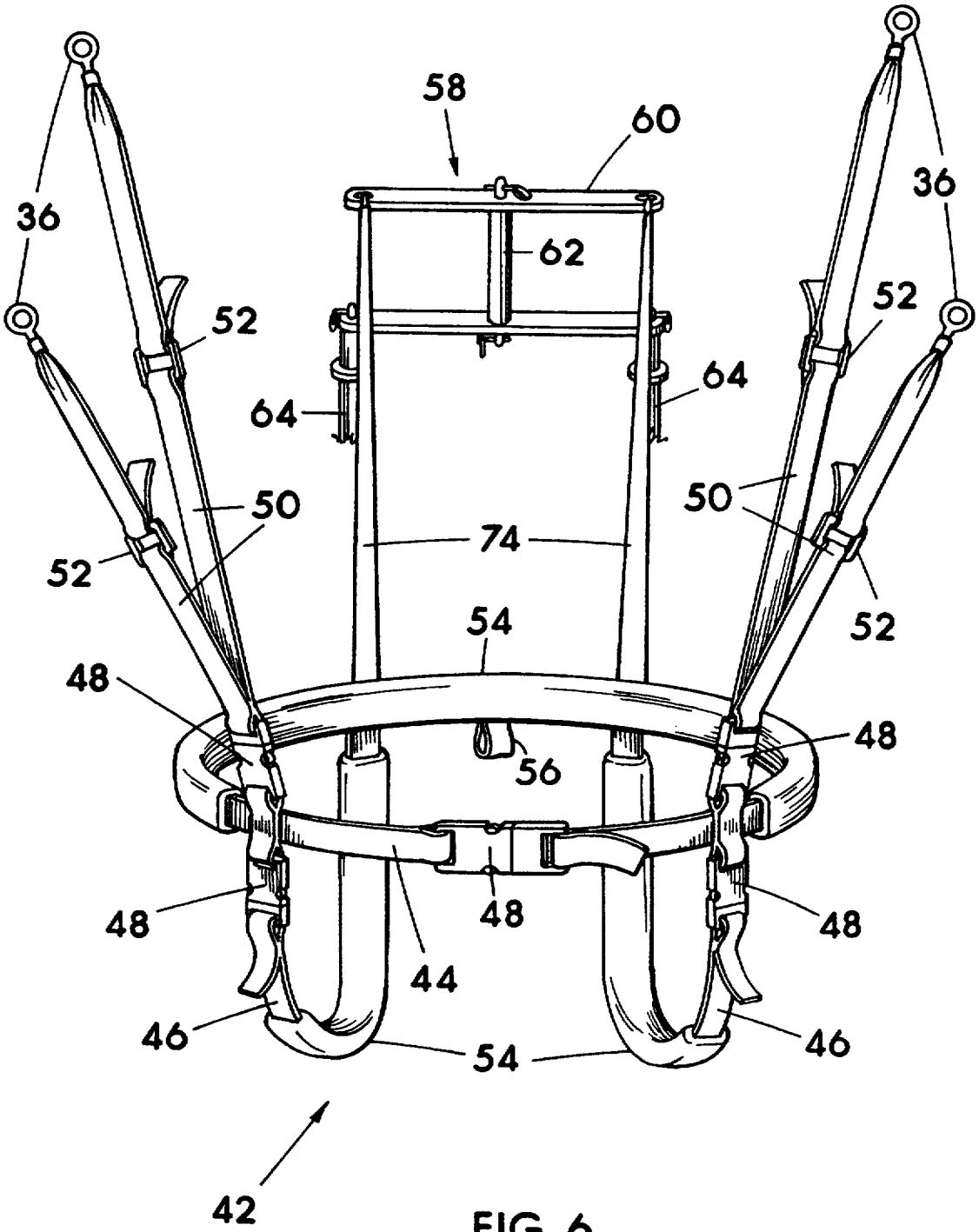
FIG. 6 showing the body harness of FIG. 5 assembled and buckled with control straps affixed and the harness attached to the swivel arm of a two-stake anchor.
Figure 7:
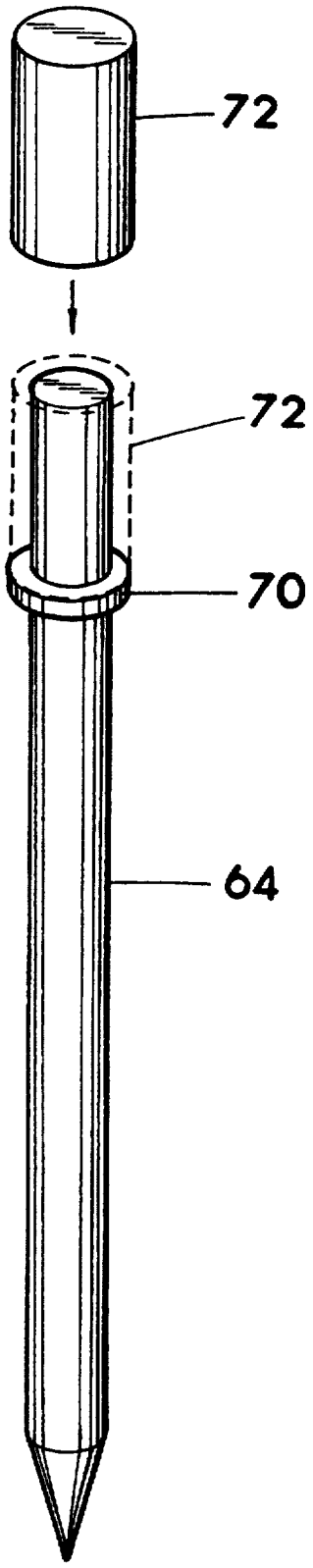
FIG. 7 showing one of the stakes used in the harness anchor and the driver cap for preventing stake damage when the stake is driven into the ground.
Figure 8:
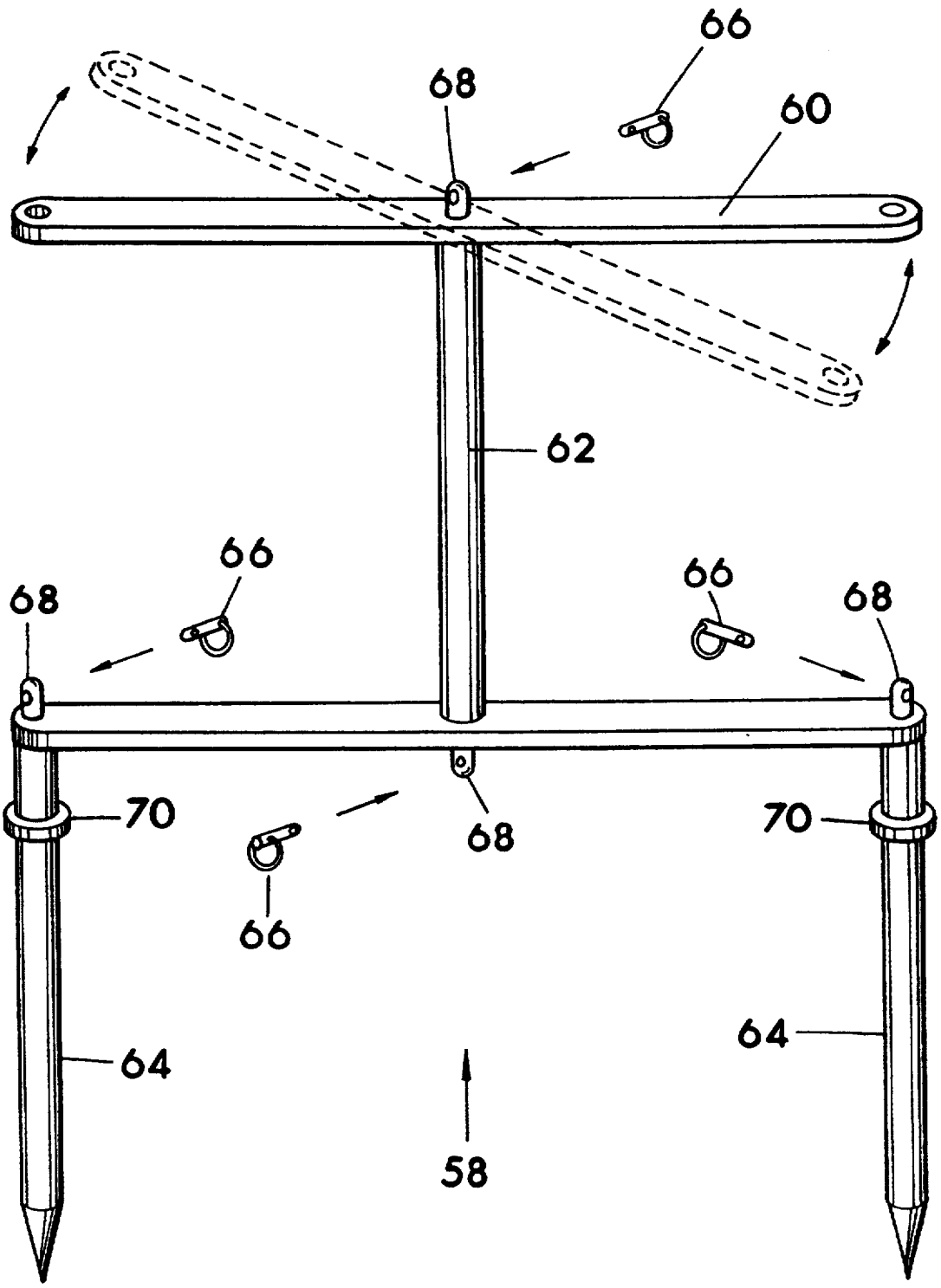
FIG. 8 showing the anchor assemblage of the present invention. The collar, swiveling arm, and attachment clips are illustrated.

Body harness 42 assembled, buckled, and attached by safety line straps 74 to staked swivel-T anchor 58 can be seen in FIG. 6. Safety straps 74 fasten to the ends of a swivel arm 60. Although shown as straps, safety straps 74 can be strong cords. Swivel arm 60 sets on top of swivel arm support 62 and can turn 360 degrees relative to an elongated rectangular platform affixed at each end by ground stakes 64. FIG. 8 shows staked swivel-T anchor 58 assembled, and FIG. 7 shows one of the ground stakes 64 enlarged. Ground stake 64 has a shock collar 70 adjacent an unsharpened end that fits below a driver cap 72. With driver cap 72 in place, shown by dotted lines, ground stake 64 can be driven into the ground without damage to the stake head. Lock pin studs 68 at both ends of swivel support arm 62 and screwed into the tops of stakes 64 are retained by clip pins 66 and hold the assembled swivel-T anchor 58 together. For storage or transportation, the removal of clip pins 66 allows swivel-T anchor 58 to be easily disassembled. Swivel arm 60 can turn completely around so that an operator wearing body harness 58 attached to swivel arm 60 can move around anchor 58 as wind conditions change.

Figure 9:
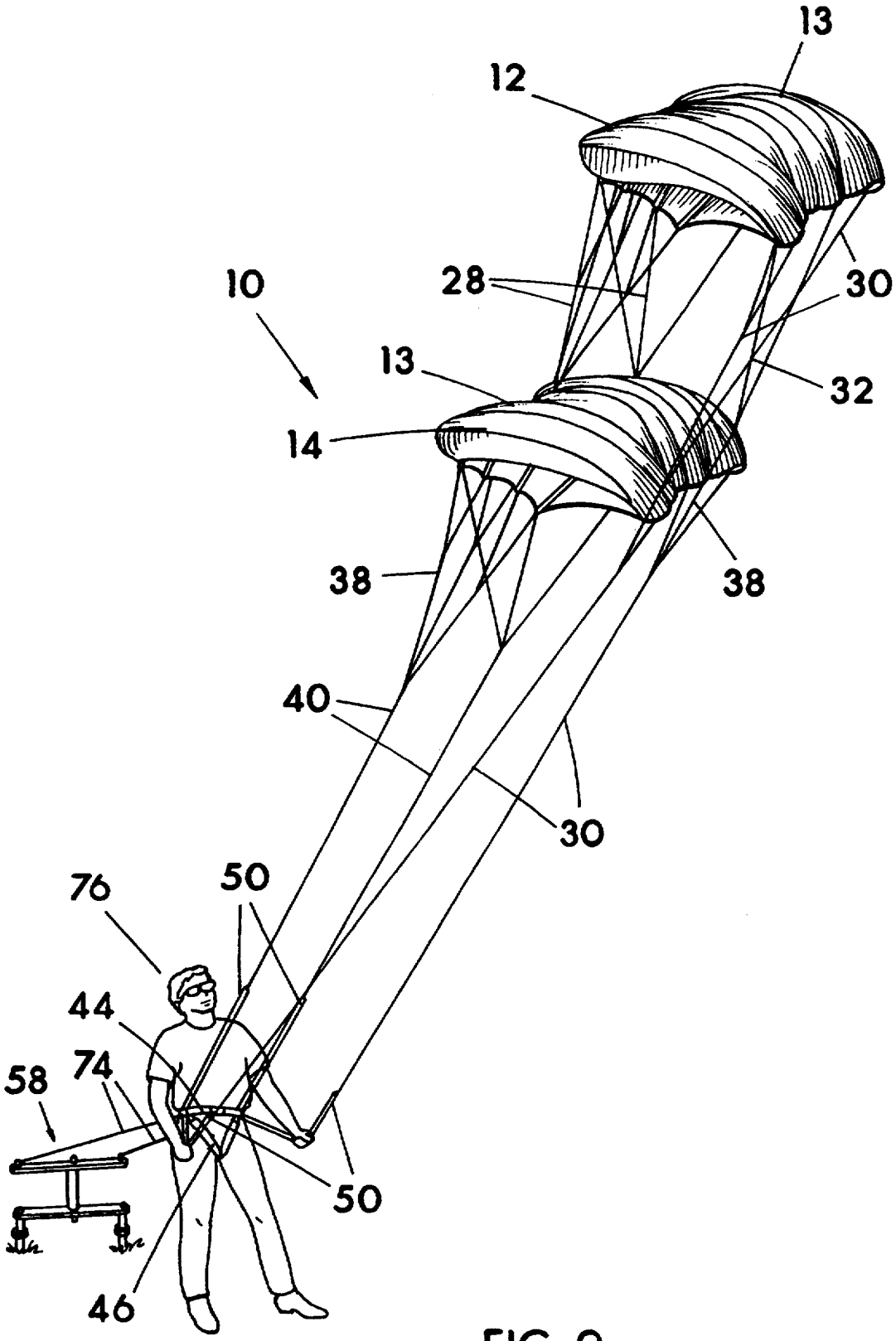
FIG. 9 showing a kite flyer in harness anchored safely to the ground while flying kites attached in stacked formation with quad line controls according to the invention.

In FIG. 9, an operator 76 is wearing belt 44 with leg straps 46 around his legs (constitutes body harness 42) and has belt 44 attached to swivel-T anchor 58. Operator 76 is flying kites 12 and 14 in attached kite-stacked formation using quad controls 21. Holding harness risers 50 away from his body, operator 76 controls brake lines 30. With body movements, operator 76 controls control lines 40 which are attached to the upper harness risers 50. FIG. 9 shows how invention 10 would be completely assembled and used. Control lines 40 attach by bridles 38 to leading edges of kites 12 and 14. Brake lines 30 attach by bridles 38 to the trailing edge of kite 14 and continue upward to also attach to the trailing edge of kite 12. X-bracing is accomplished by crossed lines 32 between brake lines 30. Frontal lead lines 28 pass through the surface 13 of kite 14 and continue controls for control lines 40 up to the leading edge of kite 12. Control lines 30 and 40 are considerably shortened in FIG. 9 for illustrative purposes. This arrangement of the complete invention 10, however, makes launching, controlling, and maneuvering stacked kites 12 and 14 easy and safe for operator 76. Operator 76 can move around swivel-T anchor 58 with wind changes and be safely secured against becoming totally airborne should a strong gust of wind increase kite lift.

Although I have described the elements of my invention with considerable detail in the foregoing specification and have illustrated them extensively in the drawings, it is to be understood that I may practice variations in the invention which do not exceed the scope of the appended claims. Also, any variations of my invention practiced by others which fall within the scope of my claims, I shall consider to be my invention.

What is claimed is:

1. A controlled ram-air inflated kite with X-braced bridle and operator harness with anchor, comprising:

a. at least one kite in airfoil form, said kite in said airfoil form being inflatable through a flexible structure, said structure including a contoured upper surface separated from a similarly contoured lower surface by dividers that form a series of air-filling cells between the surfaces running from a leading edge to a trailing edge thereof, said air-catching cells opened at said leading edge of said airfoil and closed at said trailing edge of said airfoil;

b. a bridle arrangement having means for attachment of control lines for a single said kite and for attachment of additional kites arranged in a stacked position one above another;

c. said bridle further providing a means of attachment for dual and for quad control lines;

d. X-bracing lines being an integral part of said bridle arrangement;

e. an adjustable body harness for the torso of a human operator, said body harness having means for attachment of dual and quad kite control lines, said body harness having attachment means for securing said operator when wearing said harness by anchoring; and f. means for anchoring said operator harness.

2. The device of claim 1 wherein said means for attachment of control lines for a single said kite and for attachment of additional kites arranged in a stacked position one above the other include riser lines attached to said bridle, said risers having a free end with a snap-loop attachment thereat.

3. The device of claim 1 wherein said means of attachment for dual and for quad control lines includes stabilizer lines in said bridle arrangement having snap connector loops on the ends thereof and control attachment tabs on the underside surfaces of said kite airfoils.

4. The device of claim 1 wherein said body harness having means for attachment of dual and quad kite control lines, said attachment means including short harness riser straps with line attachment loops on a free end thereof.

5. The device of claim 1 wherein said body harness includes attachment means for securing said operator to said harness, said harness being attached to an anchor, said attachment means including at least two straps on the back of said harness, said straps arranged with snap loops on the free ends of said straps, and said free ends being attachable to a receptive fitting on said anchor.

6. The device of claim 1 and claim 5 wherein said means for said anchoring includes ground stakes with hammer caps, said stakes fitting a base piece of a swiveling yoke on an anchoring assemblage, said swiveling yoke having said receptive fittings for removable attachment thereto of said harness straps.

* * * * *